US011659944B2

(12) United States Patent
Phan

(10) Patent No.: US 11,659,944 B2
(45) **Date of Patent: *May 30, 2023**

(54) DUVET COVER—DEVICES AND METHODS OF USE

(71) Applicant: Lisa Phan, Berkeley, CA (US)

(72) Inventor: Lisa Phan, Berkeley, CA (US)

( * ) Notice: Subject to any disclaimer, the term of this patent is extended or adjusted under 35 U.S.C. 154(b) by 134 days.

This patent is subject to a terminal disclaimer.

(21) Appl. No.: 17/174,358

(22) Filed: Feb. 12, 2021

(65) Prior Publication Data

US 2021/0169248 A1 Jun. 10, 2021

Related U.S. Application Data

(63) Continuation-in-part of application No. 15/878,602, filed on Jan. 24, 2018, now Pat. No. 10,932,596.

(51) Int. Cl.
*A47G 9/02* (2006.01)

(52) U.S. Cl.
CPC .... *A47G 9/0261* (2013.01); *A47G 2009/0269* (2013.01)

(58) Field of Classification Search
CPC ..... A47G 9/0261; A47G 9/02; A47G 9/0207; A47G 9/0284; A47G 2009/0269
See application file for complete search history.

(56) References Cited

U.S. PATENT DOCUMENTS

2011/0283453 A1* 11/2011 Low ..... A47G 9/0261 5/501
2016/0242559 A1* 8/2016 Hui ..... A47G 9/0246
2019/0099017 A1* 4/2019 Goldberg ..... A47G 9/0261

FOREIGN PATENT DOCUMENTS

FR 3116708 A1 * 6/2022
GB 2318051 A * 4/1998 ..... A47G 9/0261

* cited by examiner

*Primary Examiner* — David R Hare
*Assistant Examiner* — Adam C Ortiz

(57) ABSTRACT

Devices and methods that allow for rapid and efficient changing of duvet covers, comprising an upper section and a lower section of washable material that are sized to be significantly larger than a duvet that will be covered and isolated. The upper and lower sections are secured together along a single edge only, and that edge is positioned at the head of the bed. The duvet is placed between the upper and lower sections, isolating and enclosing the duvet, thereby preventing the duvet from becoming exposed while the bed is in use, and simultaneously allowing for easy and rapid changing of the duvet cover after use.

29 Claims, 10 Drawing Sheets

DUVET COVER—DEVICES AND METHODS OF USE

BACKGROUND

This present invention relates to devices and methods for efficiently isolating or covering a duvet, and making a bed.

Hotels, motels, and inns have many guests that stay overnight, and sleep in beds provided by these establishments (hereafter collectively "hotel" or "hotels"). Hotel personnel change the bed sheets after guests depart but often do not change the duvet. Many guests do not want to be exposed to an unwashed duvet that had been used by other people.

Some hotels use systems and devices to cover a duvet, and then remove and wash the duvet cover between guests. In some hotels, the system used comprises two bed sheets, wherein one sheet is placed below the duvet, and another sheet is placed on top of the duvet, and the sheets are folded over the top of the duvet. This method has the advantage of being very efficient. It is easy to strip the bed, remove the sheets from the top and bottom of the duvet, and replace them with clean sheets. However, this method has the disadvantage of not securely retaining the duvet inside the sheets while guests are in the bed. The bed sheets are simply folded over the duvet at the top of the bed; they are not secured in place. Often, while guests are sleeping, the bed sheets will separate from the duvet, exposing the duvet to the guests, and defeating the purpose of enclosing the duvet in bed sheets.

Other methods comprise using covers that securely enclose the duvet, thereby retaining the duvet inside the enclosed cover. The duvet covers are secured using means such as zippers, buttons, snaps, a hook and loop system, and the like. These systems will almost certainly prevent exposure of the duvet. But these systems are not practical when a hotel has multiple beds to change. There is inefficiency because it takes quite a bit of time to undo the zipper or other means for securing the duvet cover, remove the duvet from the cover, place the duvet in a clean cover, secure the duvet inside the clean cover, and place the duvet and cover onto the bed.

The present invention solves these problems by providing methods and devices for securely enclosing a duvet inside a cover, while at the same time allowing for rapid and efficient changing of the duvet cover.

SUMMARY

The invention comprises devices and methods that allow for rapid and efficient changing of duvet covers while securely enclosing and isolating a duvet when the duvet is in use. In a preferred embodiment, the invention comprises two sections of material that are sized to be larger than the duvet. The two sections of material are secured together along one edge only, and the secured edge is placed at or near the head of the bed. The side and bottom edges are free, and are not secured together. As used herein, free edge means at least a portion of the side edge or edges and/or portion of the bottom edge where the upper section and lower section are not secured together. In the preferred embodiment, the free edge may not have securing means.

To make the bed, the duvet cover is placed on the bed in geometric alignment with the bed and with the secured edge at or near the head of the bed. The duvet is placed between the two sections of material, thereby isolating the duvet completely inside the material. This prevents the duvet from becoming exposed while guests are using the bed, and simultaneously allows for easy and rapid changing of the duvet cover after use.

In another embodiment, a single piece of material is sized to be wider than the width of the duvet and sized to be longer than twice the length of the duvet. The single piece of material is folded along a midline, and the duvet is placed between the folded material, thereby isolating the duvet.

In another embodiment, the duvet cover may be secured along one edge that is placed at or near the head of the bed and along a small portion of each side edge, creating a small pocket in which to slip the duvet.

In another embodiment, the duvet cover may have securing means between the two sections of material (upper section and lower section), creating a means to secure the duvet in place within the duvet cover.

In another embodiment, the duvet cover may have side edge pockets running along the side edges of the lower section or upper section, creating an opening toward the inner surface of the duvet cover to allow for insertion of the corresponding side edges of the duvet.

In another embodiment, the duvet cover may have an edge pocket running along the edges (side and bottom edges) of the lower section or upper section, creating an opening toward the inner surface of the duvet cover to allow for insertion of the corresponding edges of the duvet.

In another embodiment, the duvet cover may have an edge pocket running along the edges (side and bottom edges) of the lower section, creating an opening toward the inner surface of the duvet cover to allow for insertion of the corresponding edges of the duvet and/or upper section of the duvet cover. The duvet cover may have an edge pocket running along the edges (side and bottom edges) of the upper section, creating an opening toward the inner surface of the duvet cover to allow for insertion of the corresponding edges of the duvet and/or lower section of the duvet cover.

The present invention is described using the following examples, which may describe more than one relevant embodiment falling within the scope of the present invention. Features from the described embodiments can be combined to create different embodiments falling within the scope of the present invention.

DETAILED DESCRIPTION

Figure 1:
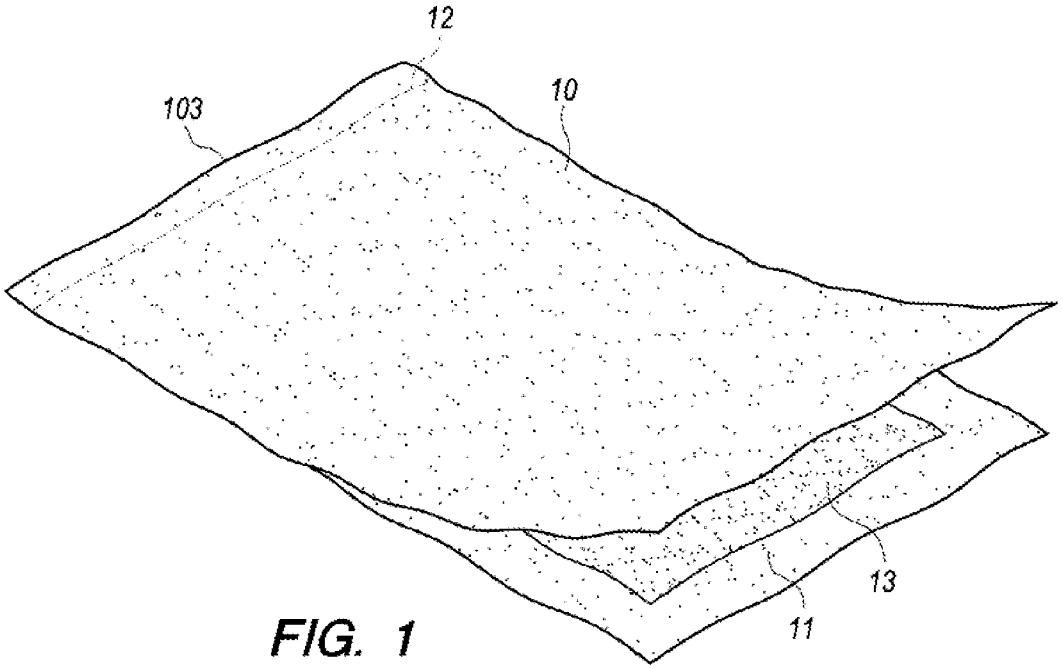
FIG. 1 is a perspective view of an embodiment of the invention with the upper section raised to expose the duvet.

In one embodiment of the invention, as shown in FIG. 1, two sections of material are used, a first upper section 10 and a second lower section 11. The material may be made from any flexible material known in the art. Non-limiting examples comprise polyester, cotton, linen, wool, flannel, rayon, modal, blended material, or any other synthetic or natural fabric, textile, or material that is washable, either machine-washable or washable by hand.

Both upper section 10 and lower section 11 are sized to be significantly larger than duvet 13, in both length and width. Duvet 13 may be of any size or shape, and each of the two sections of material is sized so that it is significantly larger than the duvet, as shown in FIG. 1. As used herein, significantly larger means that there is material in each section that extends beyond the edges of the duvet to cover and to sufficiently isolate and enclose duvet 13.

Typically, a duvet is longer than it is wide to correspond with the shape of most beds. In other words, a duvet is typically a rectangle with one of the shorter edges placed at the top, or head, of a bed, and the other shorter edge placed at the bottom, or foot, of the bed. FIG. 1 shows this embodiment where the first upper section, second lower section, and duvet are rectangular in shape. It is apparent that the duvet may be of any shape, including but not limited to square or circular, and that the first upper and second lower sections may be shaped and sized to be significantly larger than the duvet.

In some preferred embodiments, upper section 10 and lower section 11 are secured 12 along one edge only. In one embodiment, upper section 10 and lower section 11 are secured 12 together along common edge 103 of a rectangular shape, as shown in FIG. 1. In one embodiment, upper section 10 and lower section 11 are secured 12 using stitching along one of the short edges of the rectangle, common edge 103.

Upper section 10 and lower section 11 may be stitched together, or they may be secured 12 together in using any other methods known in the art, including but not limited to zippers, hook and loop systems, snaps, buttons, decorative means, the warp and weft of the fabric, or any combination thereof.

As non-limiting examples, common edge 103 may be secured together using any type of stitching, including but not limited to double stitching, zig-zag stitching, superimposed seams, lapped seams, bound seams, flat seams, decorative stitching, or any combination thereof. One example comprising double stitching 12 and 12*a* is shown in FIG. 2.

Figure 3:
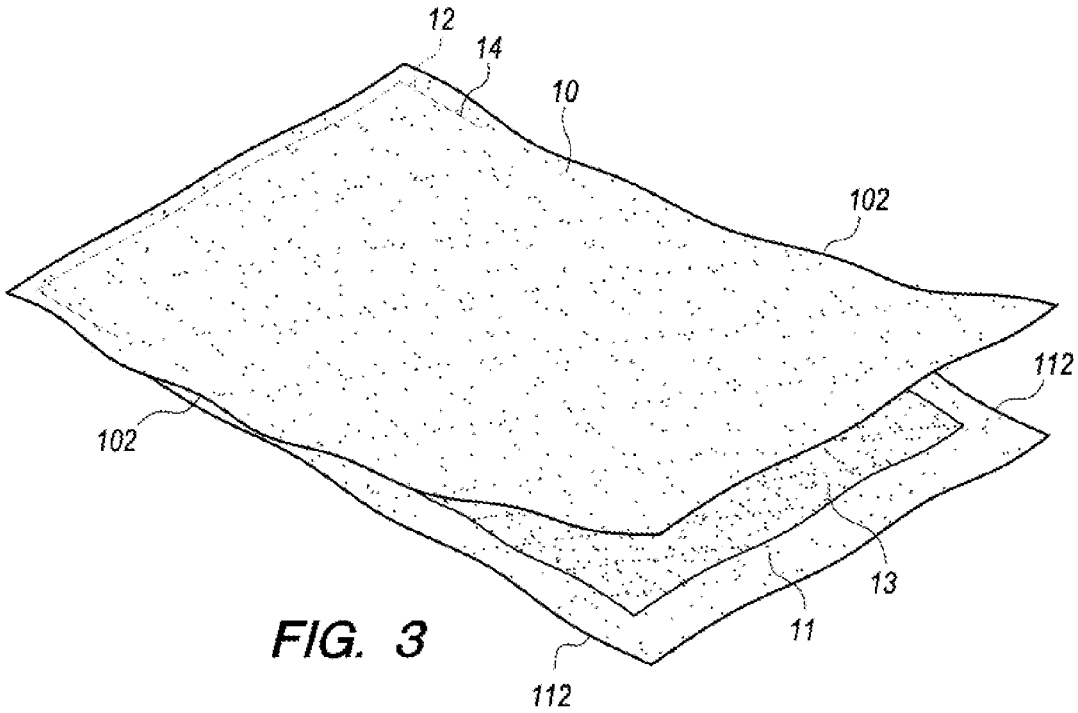
FIG. 3 is a perspective view of another embodiment of the invention with the upper section raised to expose the duvet.

FIG. 3 shows another embodiment where upper section 10 and lower section 11 are secured 12 along top edge 103, and also secured 14 along a portion of the side edges 112 and 102. This creates a small pocket in which to slip the top edge of duvet 13. Securing means 14 may comprise any of the securing means 12 described above.

Figure 4:
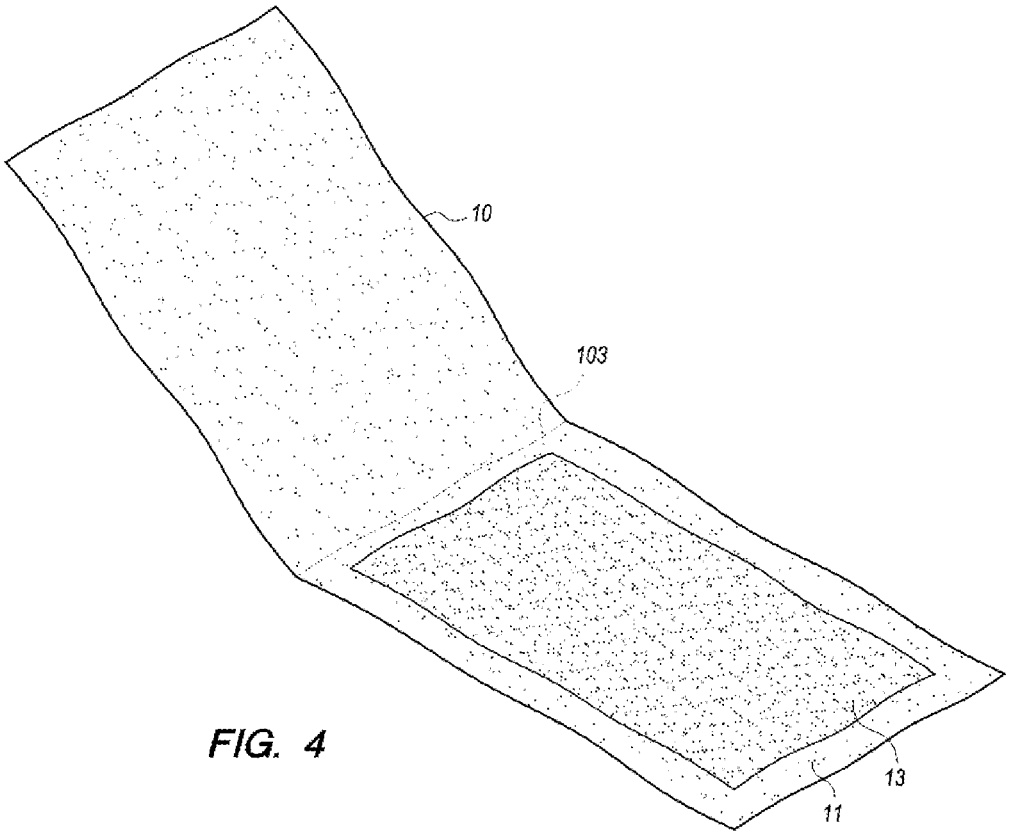
FIG. 4 is a perspective view of another embodiment of the invention with the upper section raised to expose the duvet. The embodiment may represent one sheet of material or two sheets of material.

FIG. 4 shows another embodiment using a single piece of material when common edge 103 is the warp and weft of the fabric. In this embodiment, the material is significantly wider than the width of the duvet, and is significantly longer than twice the length of the duvet, with lower section 11 and upper section 10 comprising one piece of material. To use this embodiment, the securing means 12 comprise the warp and weft of the fabric, which is folded along common edge 103 to form upper section 10 and lower section 11. In this embodiment, common edge 103 also forms midline 103, and may be marked by a fabric fold-line, stitching, print on the fabric, small cut-outs, colored fabric, colored threads, or other means of indicating a line in fabric.

Figure 2:
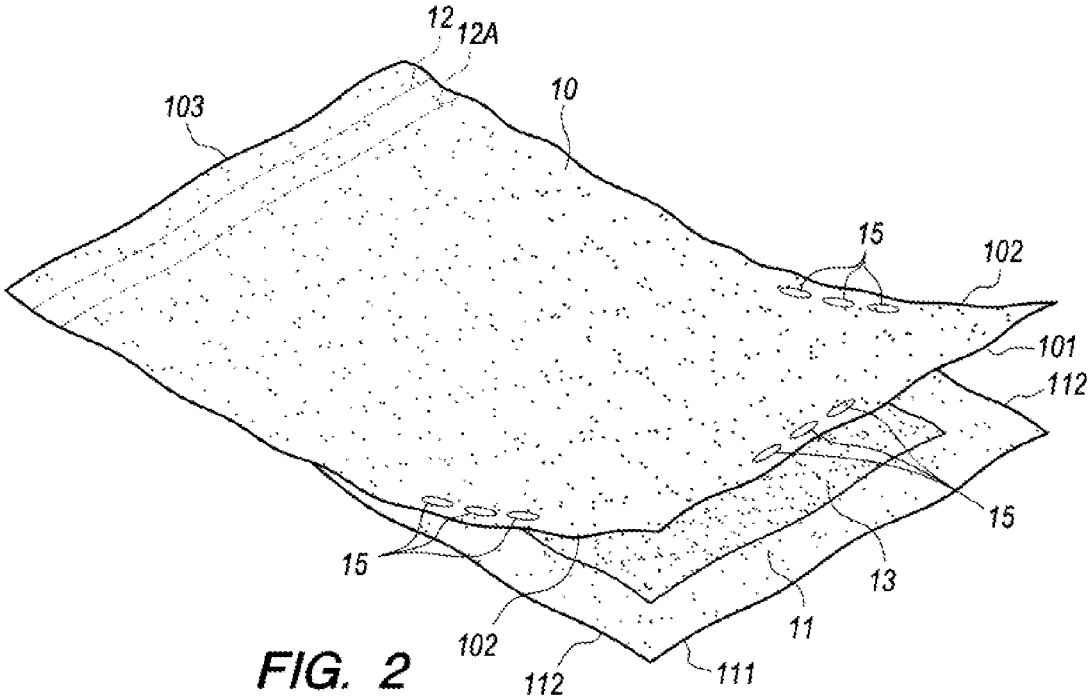
FIG. 2 is a perspective view of another embodiment of the invention with the upper section raised to expose the duvet.

In some embodiments, the edges of one or both of the sections of material may have weighted elements 15 to weigh down the side edges and bottom edge of the duvet cover, further ensuring that the duvet is isolated and covered, as shown in FIG. 2.

Weighted elements 15 may comprise decorative stitching, small weights, or other features that add weight to the material. In other embodiments, weighted elements 15 may comprise material that is doubled, tripled or otherwise folded to give weight at the side edges and bottom edge. In these embodiments, for example, each side edge 102 may be folded one or more times, and secured together by stitching or any other securing means 12. This creates multiple layers of fabric, adding weight to the side edges and bottom edge.

Weighted elements 15 may be strategically disposed along the edges of upper section 10, wherein the edges comprise side edges 102, bottom edge 101, or any combination thereof. In a similar manner, weighted elements 15 may be strategically disposed along the edges of lower section 11, wherein the edges comprise side edges 112, bottom edge 111, or any combination thereof.

In some embodiments, the duvet cover may have securing means to secure duvet 13 to the duvet cover. The securing means may be located on the inner surface of upper section 10 and/or on the inner surface of lower section 11. The securing means can be located on one corner, two corners, three corners or four corners or on the top edge, one side edge, two side edges or bottom edge, on any interior location of the inner surface of upper section 10 and/or lower section 11, or any combination thereof. In other words, the securing means can be located on any corner, edge or interior location of the inner surface of upper section 10 and lower section 11. As used herein, inner surface means the surface of the upper section and lower section that comes in contact with duvet 13.

Figure 7:
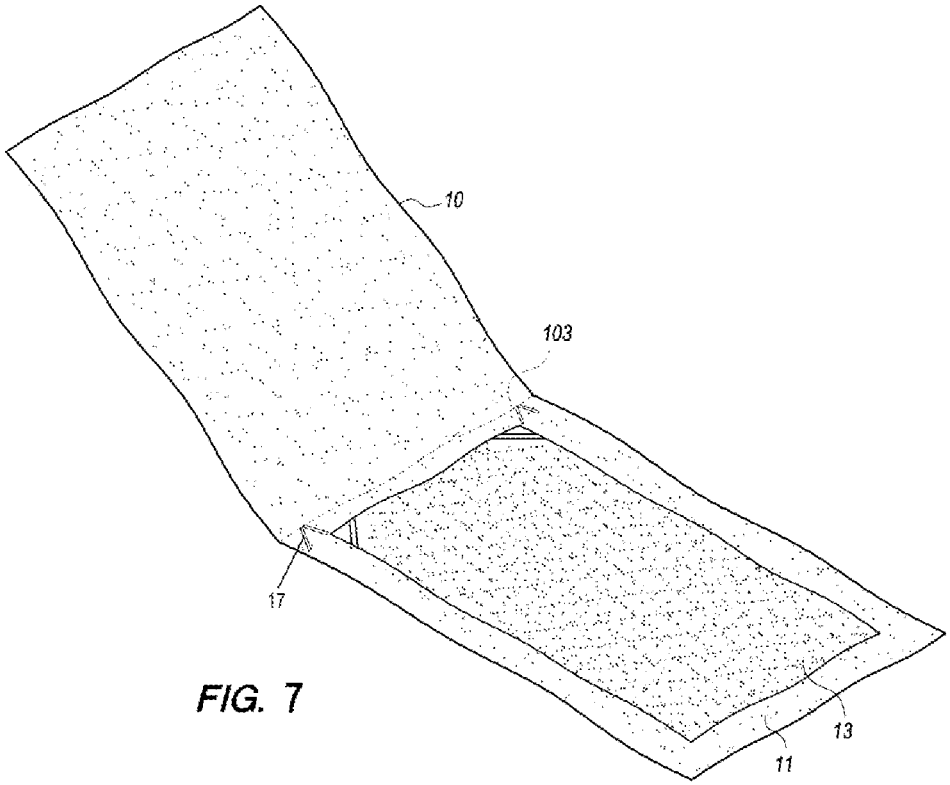
FIG. 7 is a perspective view of an embodiment of the invention with the upper section raised to expose the duvet and securing means to secure the duvet to the duvet cover.

Duvet 13 may be secured to the duvet cover using any methods known in the art, including but not limited to zippers, hook and loop systems, snaps, buttons, straps, loop and tie, decorative means, or any combination thereof. One preferred embodiment uses securing means 17 disposed at the two corners near common edge 103 on the inner surface of the duvet cover to secure duvet 13 to the duvet cover as shown in FIG. 7.

Figure 8:
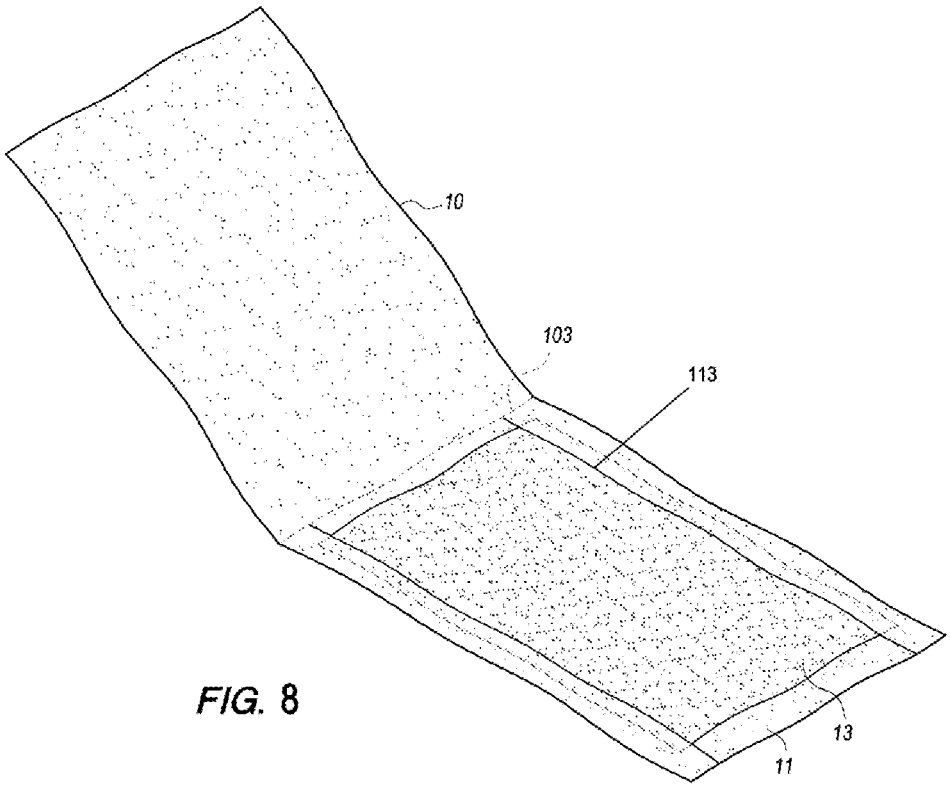
FIG. 8 is a perspective view of an embodiment of the invention with the upper section raised to expose the duvet inserted into the side edge pockets of the lower section of the duvet cover.
Figure 9:
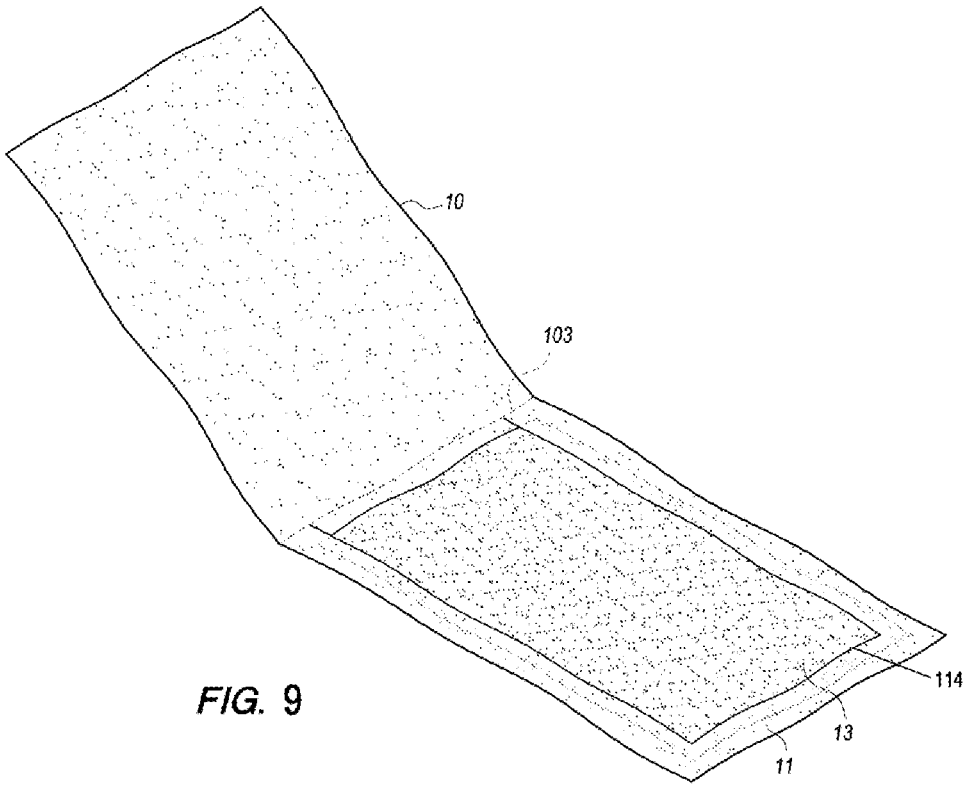
FIG. 9 is a perspective view of an embodiment of the invention with the upper section raised to expose the duvet inserted into the edge pocket of the lower section of the duvet cover.

In some embodiments, side edge pockets and/or bottom edge pocket may be disposed along the edges of the inner layer of lower section 11 and/or upper section 10, wherein the opening of the pocket or pockets are disposed toward the inner surface of the duvet cover to allow for the insertion of the side edges and/or bottom edge of duvet 13 and/or other section of the duvet cover into the edge pocket or pockets. The edge pocket or pockets run a portion of the length of the edge of the duvet cover. Where there exists a side pocket that meets the bottom pocket, the front layer of both pockets is secured together and not secured to the back layer as to allow an opening for insertion of the corner of the duvet. In the preferred embodiment where both side edge pockets and bottom edge pocket are disposed along the edges of the duvet cover, a single edge pocket 114 is formed that runs along a portion of the edges of lower section 11 and allows for insertion of the corresponding edges of duvet 13 as shown in FIG. 9. Although in this case there is only one pocket formed, the use of the terms side edge pocket and bottom edge pocket indicates that there is a side edge opening for which to insert the side edge of duvet 13 and a bottom edge opening for which to insert the bottom edge of duvet 13. FIG. 8 shows a preferred embodiment comprised of two side edge pockets 113 disposed along a portion of the side edge of lower section 11 to insert the side edges of duvet 13.

Figure 10:
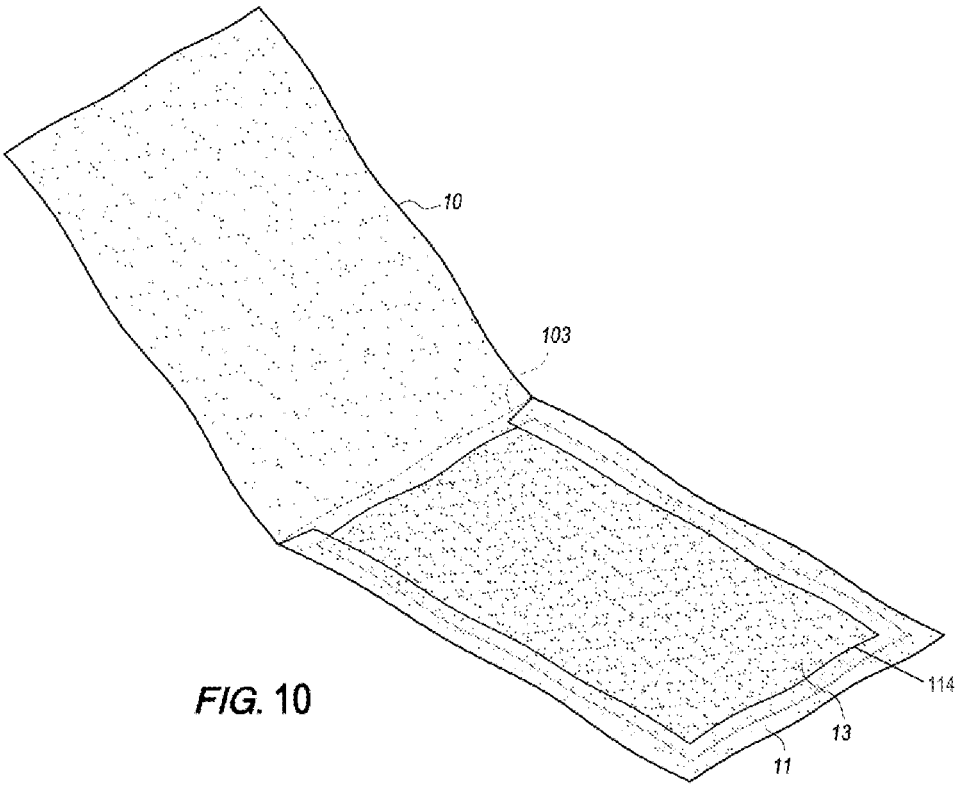
FIG. 10 is a perspective view of an embodiment of the invention with the upper section raised to expose the duvet inserted into the edge pocket of the lower section of the duvet cover, wherein the edges of the pocket near the top edge of the duvet cover is not secured.
Figure 11:
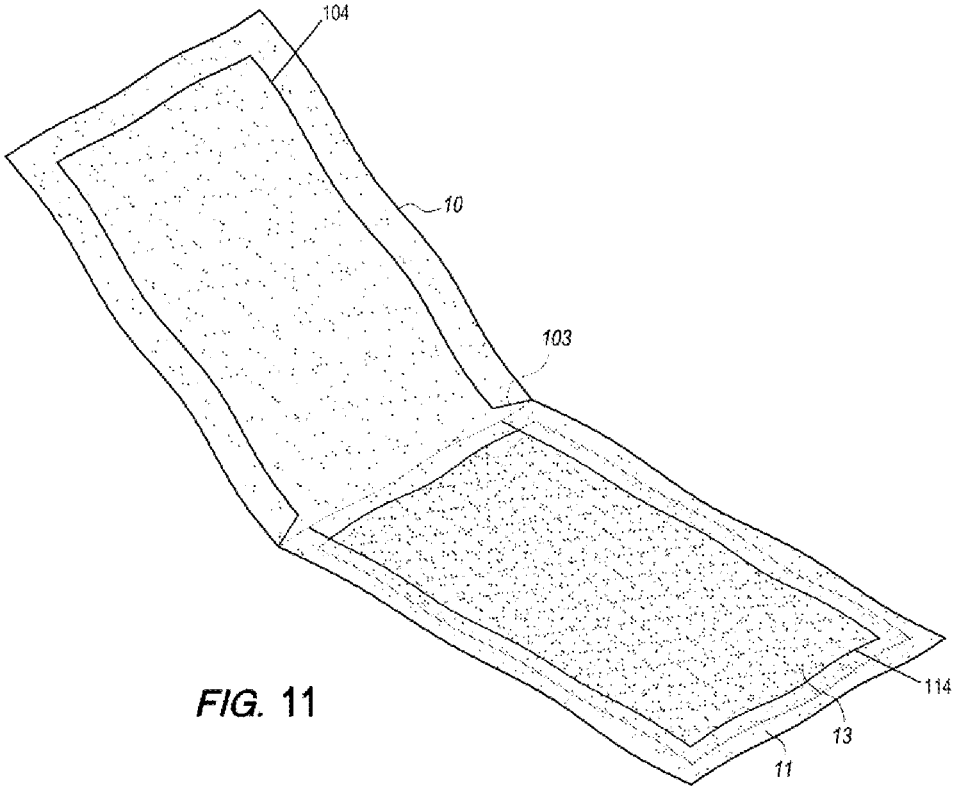
FIG. 11 is a perspective view of an embodiment of the invention with the upper section raised to expose the duvet inserted into the edge pocket of the lower section of the duvet cover. The view exposes an edge pocket on the upper section with edges of the pocket near the top edge of the duvet cover not secured.
Figure 12:
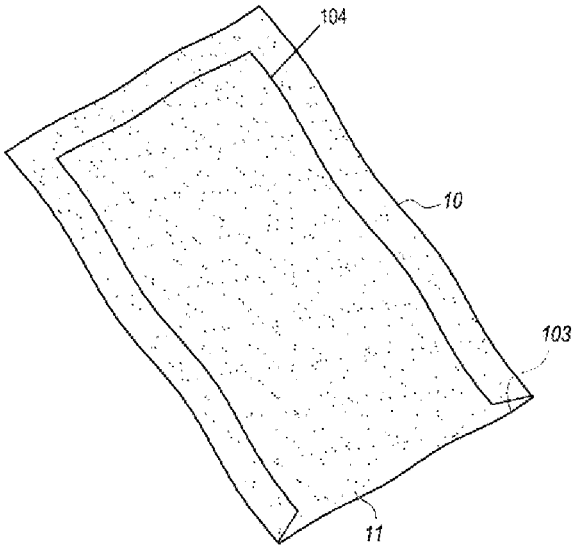
FIG. 12 is a perspective view of an embodiment of the invention with the edges of one of the sections inserted into the edge pocket of the other section of the duvet cover.

In some embodiments, the edge pocket or pockets disposed on the inner layer of lower section 11 and/or upper section 10 may have unsecured edges of the pocket or pockets located near common edge 103, wherein the front layer and the back layer of the pocket are not secured together. The preferred embodiments with unsecured edges of edge pocket 114 of lower section 11 and edge pocket 104 of upper section 10 are shown in FIG. 10 and FIG. 11 respectively. In these embodiments, the edge pocket opening or openings created may allow for the insertion of the edges of one of the sections into the edge pocket or pockets of the other section. In the preferred embodiment shown in FIG. 11, the duvet is inserted into edge pocket 114 of lower section 11. Then as shown in FIG. 12, the edge of lower section 11 is inserted into edge pocket 104 of upper section 10.

The edge pocket or pockets of the duvet cover may have secured or unsecured pocket edges when the pocket edge is located near common edge 103 of the duvet cover. As used herein, edge pocket means a pocket or pockets located on the edge of the duvet cover that may or may not have secured pocket edges when the pocket edge is located near common edge 103 of the duvet cover.

The secured edges of the edge pocket or pockets on lower section 11 or upper section 10 may be sewn or secured by using any other methods known in the art, including but not limited to zippers, hook and loop systems, snaps, buttons, ties, decorative means, the warp and weft of the fabric, or any combination thereof.

In some embodiments, securing means are located on the back surface of one of the sections of material at the top two corners and the unsecured pocket edges near common edge 103 to secure the unsecured edges of the edge pocket or pockets of the other section of material.

Figure 5:
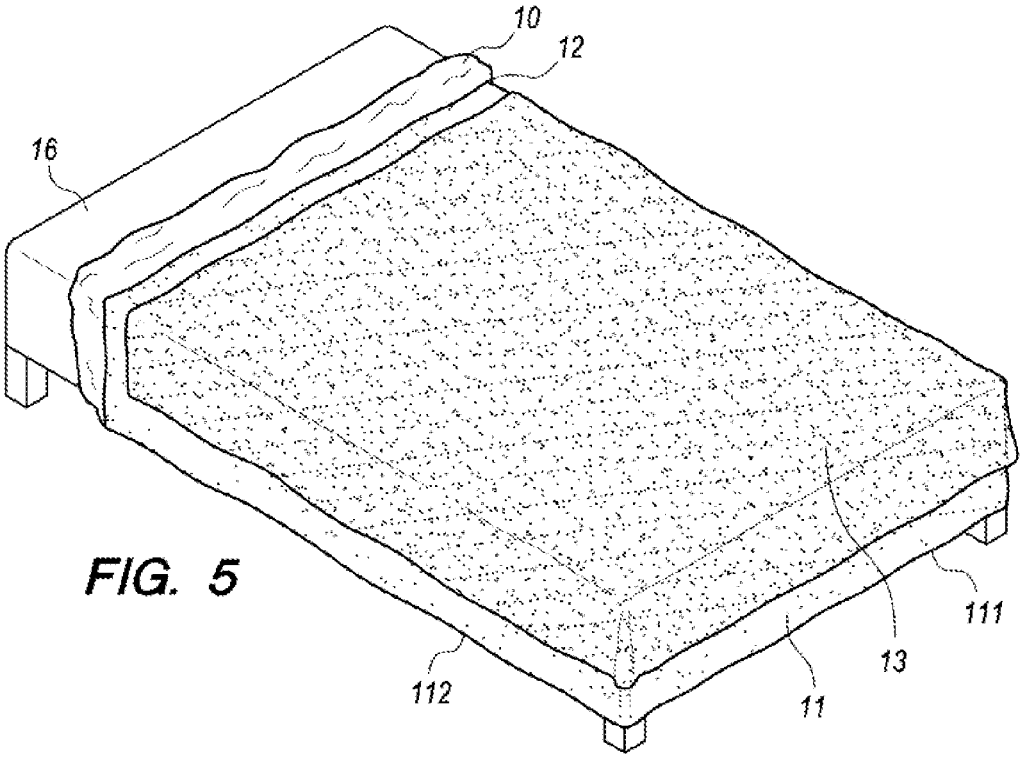
FIG. 5 is a perspective view of an embodiment of a step in a method of using the invention.

The invention may be used to quickly and efficiently make and unmake a bed. In one embodiment, lower section 11 is placed on top of a bed 16, as shown in FIG. 5. Typically, bed 16 has a fitted sheet and flat sheet over a mattress.

Figure 6:
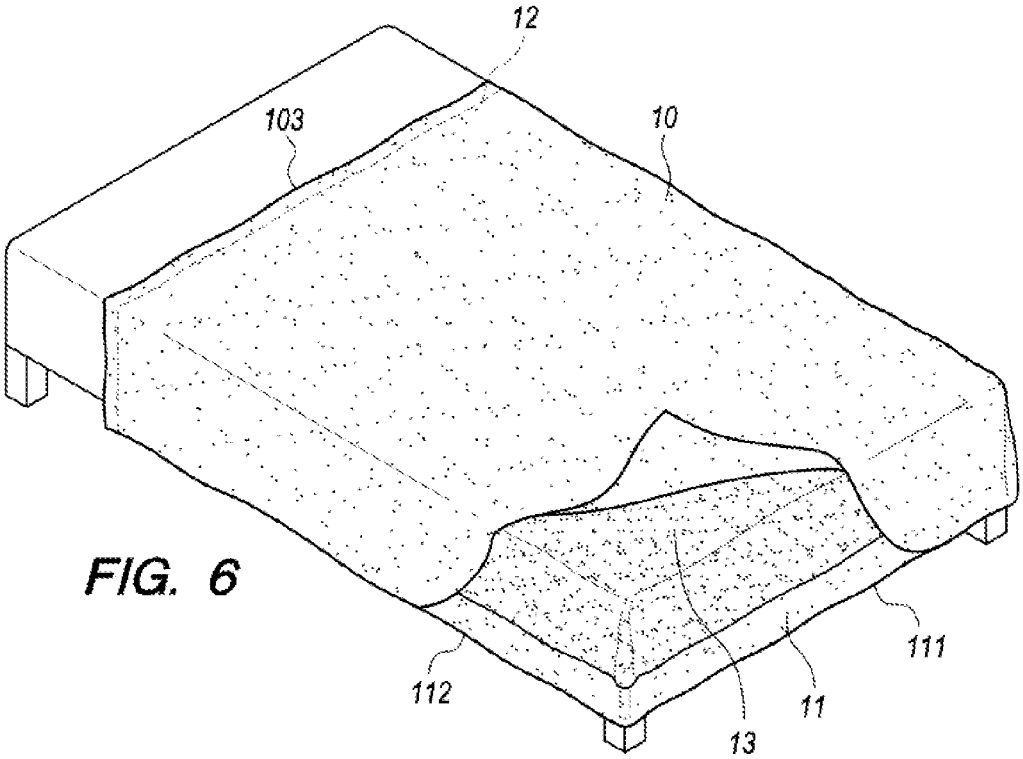
FIG. 6 is a perspective view of an embodiment of a step in a method of using the invention.

Lower section 11 is centrally positioned in substantial geometric alignment over bed 16 with edges 112 and 111 hanging down the sides of the bed. Common edge 103 is positioned at or near the head of the bed, as shown in FIG. 6. Upper section 10 is pulled, folded, or rolled back along common edge 103, exposing a top surface of lower section 11. In some embodiments, as shown in FIG. 5, upper section 10 is pulled back to and folded along securing means 12.

Duvet 13 is centrally positioned, in substantial geometric alignment, adjacent to the top surface of lower section 11 and bed 16, as seen in FIG. 5. The top edge of the duvet is positioned at or near common edge 103. Once duvet 13 is in place, upper section 10 is pulled, unfolded, or unrolled, and positioned on top of duvet 13, with the bottom surface of section 10 adjacent to duvet 13. FIG. 6 shows upper section 10 partially unfolded on top of and adjacent to duvet 13. When upper section 10 is fully unfolded and extended, the entire duvet 13 is enclosed and isolated inside the duvet cover, and on top of bed 16.

To unmake the bed, the duvet cover and duvet are removed from the mattress by any means known in the art. The duvet is removed from inside the duvet cover. A clean duvet cover is positioned on bed 16 as described above, by centering lower section 11 in substantial geometric alignment on top of bed 16 with common edge 103 positioned at or near the head of the bed. The process described herein is repeated to position duvet 13 between and adjacent to upper section 10 and lower section 11, thereby isolating duvet 13 from the exterior. This process is repeated as often as needed.

A similar method is used to make a bed using the embodiment shown in FIG. 3. Lower section 11 is centrally positioned in substantial geometric alignment on top of mattress 16, with edge 103 at the top of the bed. Upper section 10 is pulled or folded back, although it cannot be entirely folded back due to stitching 14 that runs along, and secures, a portion of side edges 112 and 102. Upper section 10 is pulled back as far as stitching 14 will allow. Duvet 13 is positioned in substantial geometric alignment with the duvet cover and adjacent to the top surface of lower section 11 by slipping the edge of duvet 13 into the small pocket created by securing means 14 and securing means 12. Once duvet 13 is in place, upper section 10 is pulled, unfolded, or unrolled, and positioned on top of duvet 13 so that the bottom surface of upper section 10 is adjacent to the duvet.

To unmake the bed, the duvet cover and duvet are removed from the mattress by any means known in the art. The duvet is removed from inside the duvet cover. A clean duvet cover is positioned on bed 16 as described above, by centering lower section 11 on bed 16 with common edge 103 positioned near the head of the bed. The process described herein is repeated to enclose and isolate duvet 13 between and adjacent to upper section 10 and lower section 11. This process is repeated as often as needed.

A similar method is used to make and unmake a bed using the embodiment shown in FIG. 4. To use this embodiment, the duvet cover is centrally positioned on bed 16 with lower section 11 of the material laid on top of the mattress and sheets. Lower section 11 is in substantial geometric alignment with bed 16. Midline 103 is positioned at or near the head of the bed. Upper section 10 of the material is pulled, folded, or rolled back at or near midline 103 exposing the top surface of lower section 11. Duvet 13 is placed in substantial geometric alignment on top of and adjacent to the exposed top surface of section 11. The other half of the material, section 10, is pulled, unfolded or unrolled over the top of, and adjacent to, duvet 13, enclosing and isolating duvet 13, thereby sandwiching duvet 13 in between upper section 10 and lower section 11.

To unmake the bed using this embodiment the duvet cover and duvet are removed from bed 16 by any means known in the art. Duvet 13 is removed from the duvet cover. A clean duvet cover is positioned on bed 16 as described above, by centering lower section 11 in substantial geometric alignment on bed 16 with midline 103 positioned at or near the head of bed 16. The process described herein is repeated to enclose and isolate duvet 13 between upper section 10 and lower section 11. This process is repeated as often as needed.

A similar method is used to make a bed using the embodiments shown in FIGS. 7 through 12. Lower section 11 is centrally positioned in substantial geometric alignment over bed 16 with edges 112 and 111 hanging down the sides of the bed. Common edge 103 is positioned at or near the head of the bed, as shown in FIG. 6. Upper section 10 is pulled, folded, or rolled back along common edge 103, exposing a top surface of lower section 11. In some embodiments, as shown in FIG. 5, upper section 10 is pulled back to and folded along securing means 12.

Duvet 13 is centrally positioned, in substantial geometric alignment, adjacent to the top surface of lower section 11 and bed 16, as seen in FIG. 5. The top edge of the duvet is positioned at or near common edge 103. Once duvet 13 is in place, if the embodiment has securing means to secure the duvet to the duvet cover, the duvet may be secured to the duvet cover using the securing means. If the embodiment has edge pocket or pockets, the side edges and/or bottom edge of the duvet may be inserted into the edge pocket or pockets of lower section 11. For one of the preferred embodiments shown in FIG. 8, insert the side edges of duvet 13 into side edge pockets 113 of lower section 11. For the preferred embodiments shown in FIGS. 9, 10 and 11, insert the edges of the duvet into edge (side edges and bottom edge) pocket 114 of lower section 11. Upper section 10 is pulled, unfolded, or unrolled, and positioned on top of duvet 13, with the bottom surface of upper section 10 adjacent to duvet 13. FIG. 6 shows upper section 10 partially unfolded on top of and adjacent to duvet 13. When upper section 10 is fully unfolded and extended, the entire duvet 13 is enclosed and isolated inside the duvet cover, and on top of bed 16. If upper section 10 has edge pocket or pockets with edges of the pocket or pockets near the top edge of the duvet cover not secured, the edge of lower section 11 may be inserted into the edge pocket or pockets of upper section 10. For one of the preferred embodiments shown in FIG. 11, insert edges of the duvet inserted lower section 11 into edge (side edges and bottom edge) pocket 104 of the upper section 10. The finished insertion is shown in FIG. 12. In another embodiment, after duvet 13 is inserted into the pocket or pockets of lower section 11, upper section 10 may be inserted into the pocket or pockets of lower section 11. The duvet cover may be flipped over so that upper section 10 is now adjacent to bed 16, and lower section 11 is now the outer surface of the duvet cover. Now upper section 10 becomes lower section 11 and lower section 11 becomes upper section 10. The outer surface of the duvet cover that is not adjacent to bed 16 should have no exposed pocket or pockets. For another embodiment, after duvet 13 is in place adjacent to the top surface of lower section 11 and upper section 10 is fully unfolded and extended, the edges of duvet 13 may be inserted into edge pocket or pockets of upper section 10. Then the edges of lower section 11 may be inserted into the edge pocket or pockets of upper section 10. If securing means are present to secure the unsecured edges of the edge pocket of upper section 10 to lower section 11, the securing means may be secured.

CONCLUSIONS, OTHER EMBODIMENTS, AND SCOPE OF INVENTION

The above description presents the best mode, and preferred embodiments contemplated in carrying out the invention. However, it will be apparent to one with skill in the art that the invention described herein may be provided using some or all of the mentioned features and components without departing from the spirit and scope of the present invention. It will also be apparent to the skilled artisan that the embodiments described above are specific examples of an inventive concept, which may have greater scope than any of the singular descriptions taught. There may be many alterations made in the descriptions without departing from the spirit and scope of the present invention.

What is claimed is:

1. A duvet cover comprising: a first upper section of material having an overall width dimension and an overall length dimension larger than the overall width and length dimensions of a duvet to be covered; a second lower section of material having an overall width dimension and an overall length dimension larger than the overall width and length dimensions of the duvet to be covered, wherein the first and second sections of material are formed of a fabric, wherein the second lower section of material is sewn to or secured to the first upper section of material along only one common edge of the first and second sections laid one over the other, leaving a free edge extending along at least a portion of two side edges and along a bottom edge of the first and second sections, the bottom edge being both distal from and parallel to the common edge; stitching or securing means extending parallel to the overall width dimension of the first and second sections, said stitching or securing means further being along the common edge of the first and second sections; and wherein the first and second sections of material are configured to be secured together only along the common edge via said stitching or securing means and not secured together along the portion of the side edges and the bottom edge; and wherein the duvet cover further comprises weighted elements disposed along the side and bottom free edges thereof, the weighted elements functioning to weigh the duvet cover down over the side edges and bottom edge of a bed; and wherein side edge pocket or pockets and/or bottom edge pockets are sewn into the fabric or otherwise attached to the fabric.

2. The duvet cover of claim 1, wherein the fabric is fabricated from a washable fabric including polyester, cotton, linen, wool, flannel, rayon, modal, blended fabrics, or synthetic or natural materials.

3. The duvet cover of claim 1, wherein the second section of material is secured to the first section of material by a snap, zipper, hook and loop system, button, decorative stitching, double stitching, warp and weft of the fabric, or combination thereof.

4. The duvet cover of claim 1, wherein the weighted elements are sewn into the fabric or otherwise attached to the fabric.

5. The duvet cover of claim 1, wherein securing means are attached to the corner or corners and/or edge or edges and/or surface in contact with the duvet to act to secure the duvet to the duvet cover.

6. The duvet cover of claim 1, wherein the duvet is secured to the duvet cover by a snap, zipper, hook and loop, button, loop and tie, stitching, double stitching, decorative stitching, or a combination thereof.

7. The duvet cover of claim 1, wherein the edges of the pockets are secured to the upper section or lower section by a snap, zipper, hook and loop system, button, decorative stitching, double stitching, warp and weft of the fabric, or combination thereof.

8. A method for isolating a duvet with a duvet cover, the duvet cover comprising: a first upper section of material having an overall width dimension and an overall length dimension larger than the overall width and length dimensions of a duvet to be covered; a second lower section of material having an overall width dimension and an overall length dimension larger than the overall width and length dimensions of the duvet to be covered, wherein the first and second sections of material are formed of a fabric, wherein the second lower section of material is sewn to or secured to the first upper section of material along only one common edge of the first and second sections laid one over the other, leaving a free edge extending along at least a portion of two side edges and along a bottom edge of the first and second sections, the bottom edge being both distal from and parallel to the common edge; stitching or securing means extending parallel to the overall width dimension of the first and second sections, said stitching or securing means further being along the common edge of the first and second sections; and wherein the first and second sections of material are configured to be secured together only along the common edge via said stitching or securing means and not secured together along the portion of the side edges and the bottom edge; and wherein the duvet cover further includes weighted elements strategically disposed along the side and bottom free edges thereof, the weighted elements functioning to weigh the duvet cover down over the side edges and bottom edge of the bed; and wherein side edge pocket or pockets and/or bottom edge pockets are sewn into the fabric or otherwise attached to the fabric; and comprising the acts: a) position the duvet cover, the material sections stacked one over the other, over a bed with the common edge disposed across the width of the bed and near the head of the bed; b) pull up the upper section from the foot of the bed and dispose the upper section toward the head of the bed and past the common edge of the duvet cover; c) position the duvet adjacent to an upper surface of the lower section in substantial geometric alignment with the lower section with a top edge of the duvet disposed toward the head of the bed and parallel to the common edge of the duvet cover; and d) pull down the upper section from the head to the foot of the bed and dispose the upper section adjacent to the duvet and over the lower material section of the duvet cover and the duvet.

9. The method of claim 8, wherein the fabric is fabricated from a washable fabric including polyester, cotton, linen, wool, flannel, rayon, modal, blended fabrics, or synthetic or natural materials.

10. The method of claim 8, wherein the second section of material is secured to the first section of material by a snap, zipper, hook and loop, button, stitching, double stitching, decorative stitching, warp and weft of the fabric, or a combination thereof.

11. The method of claim 8, wherein the weighted elements are sewn into the fabric or otherwise attached to the fabric.

12. The method of claim 8, wherein securing means are attached to the corner or corners and/or edge or edges and/or surface in contact with the duvet to act to secure the duvet to the duvet cover.

13. The method of claim 12, wherein the duvet is secured to the duvet cover by a snap, zipper, hook and loop, button, loop and tie, stitching, double stitching, decorative stitching, or a combination thereof.

14. The method of claim 13, wherein the securing means that attach the duvet to the duvet cover are secured after the duvet is positioned adjacent to an upper surface of the lower section.

15. The method of claim 8, wherein the edges of the pockets are secured to the upper section or lower section by a snap, zipper, hook and loop system, button, decorative stitching, double stitching, warp and weft of the fabric, or combination thereof.

16. The method of claim 15, wherein securing means are present to secure the unsecured edges of the upper section edge pocket to the lower section.

17. The method of claim 16, wherein the duvet side edges and/or bottom edge are inserted into the side edge pockets and/or bottom edge pocket of the lower section or upper section after the duvet is positioned adjacent to an upper surface of the lower section of the duvet cover.

18. The method of claim 17, wherein side edges and/or bottom edge of the duvet inserted duvet cover is inserted into the side edge pockets and/or the bottom edge pocket of the opposite section of the duvet cover.

19. The method of claim 18, wherein secure the unsecured edges of the upper section edge pocket to the lower section of the duvet cover.

20. The method of claim 17, wherein the upper section is inserted into the edge pocket or pockets of the lower section and the duvet cover is flipped over.

21. The method of claim 20, wherein secure the unsecured edges of the upper section edge pocket to the lower section of the duvet cover.

22. The method of claim 17, wherein the lower section is inserted into the edge pocket or pockets of the upper section.

23. The method of claim 22, wherein secure the unsecured edges of the upper section edge pocket to the lower section of the duvet cover.

24. The method of claim 14, wherein side edge pocket or pockets and/or bottom edge pockets are sewn into the fabric or otherwise attached to the fabric.

25. The method of claim 24, wherein the edges of the pockets are secured to the upper section or lower section by a snap, zipper, hook and loop system, button, decorative stitching, double stitching, warp and weft of the fabric, or combination thereof.

26. The method of claim 25, wherein the duvet side edges and or bottom edge are inserted into the side edge pockets and/or bottom edge pocket of the lower section or upper section after the duvet is secured to the duvet cover.

27. The method of claim 26, wherein side edges and/or bottom edge of the duvet inserted duvet cover is inserted into the side edge pockets and/or the bottom edge pocket of the upper section or lower section.

28. The method of claim 27, wherein securing means are present to secure the unsecured edges of the upper section edge pocket to the lower section.

29. The method of claim 28, wherein secure the unsecured edges of the upper section edge pocket to the lower section of the duvet cover.

* * * * *